US008021200B2

(12) United States Patent
Myer et al.

(10) Patent No.: US 8,021,200 B2
(45) Date of Patent: Sep. 20, 2011

(54) SOCKET CONTACT

(75) Inventors: John Mark Myer, Millersville, PA (US); John Wesley Hall, Harrisburg, PA (US); Hurley Chester Moll, Hershey, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/755,885

(22) Filed: Apr. 7, 2010

(65) Prior Publication Data

US 2010/0197177 A1 Aug. 5, 2010

Related U.S. Application Data

(63) Continuation-in-part of application No. 12/185,493, filed on Aug. 4, 2008, now abandoned.

(51) Int. Cl.
*H01R 13/11* (2006.01)

(52) U.S. Cl. ..... 439/857; 439/910

(58) Field of Classification Search ..... 439/852, 439/854, 857, 910
See application file for complete search history.

(56) References Cited

U.S. PATENT DOCUMENTS

| | | | | |
|---|---|---|---|---|
| 3,713,080 | A * | 1/1973 | Kennedy | 439/852 |
| 4,408,824 | A | 10/1983 | Weidler | |
| 4,684,191 | A | 8/1987 | Feher et al. | |
| 4,685,886 | A | 8/1987 | Denlinger et al. | |
| 5,195,910 | A | 3/1993 | Enomoto et al. | |
| 5,575,696 | A | 11/1996 | Endo et al. | |
| 5,941,741 | A | 8/1999 | Dobbelacre et al. | |
| 6,010,377 | A * | 1/2000 | Dechelette et al. | 439/851 |
| 6,402,571 | B1 | 6/2002 | Muller et al. | |
| 6,547,608 | B2 * | 4/2003 | Sato et al. | 439/852 |
| 6,592,406 | B2 | 7/2003 | Liu | |
| 7,086,912 | B2 | 8/2006 | Matsuura et al. | |
| 7,255,609 | B1 | 8/2007 | Epstein | |
| 7,402,089 | B1 * | 7/2008 | Myer et al. | 439/877 |
| 2001/0051472 | A1 | 12/2001 | Sato et al. | |
| 2002/0077001 | A1 | 6/2002 | Chen | |
| 2002/0086590 | A1 * | 7/2002 | Mitani et al. | 439/852 |
| 2004/0127107 | A1 | 7/2004 | Lischeck et al. | |

FOREIGN PATENT DOCUMENTS

| | | |
|---|---|---|
| DE | 202004006433 | 9/2004 |
| EP | 1720219 A1 | 11/2006 |

* cited by examiner

*Primary Examiner* — Michael Zarroli
*Assistant Examiner* — Harshad Patel

(57) ABSTRACT

A socket contact having a mating portion, a crimp portion, and a transition region connecting the mating portion with the crimp portion. The mating portion includes a first contact beam and a second contact beam. The first contact beam has a cantilevered portion with at least one first contact finger with a first contact point. The first contact beam also has an inflexible first fixed contact point which is positioned on the surface of the first contact beam. As a mating pin is inserted through the front aperture of the mating portion, the mating pin engages the first finger contact point causing the first contact beam to deflect. The mating pin then engages the inflexible first fixed contact point at a shallow mating angle and a reduced normal force, resulting in the first contact beam of the mating portion of the socket contacting the mating pin at multiple points of contact.

18 Claims, 5 Drawing Sheets

SOCKET CONTACT

CROSS-REFERENCES TO RELATED APPLICATIONS

This application is a Continuation-in-Part application under 35 U.S.C. §121 of U.S. patent application Ser. No. 12/185,493 filed Aug. 4, 2008, now abandoned incorporated by reference in its entirety.

FIELD OF THE INVENTION

The invention relates to electrical contacts, and more particularly to wire contacts for use with sealed connectors.

BACKGROUND OF THE INVENTION

Currently electrical contacts or wire contacts are used to terminate a wire. Wire contacts require a strong mechanical means of attaching to the wire to create a permanent termination and a means to mate to a mating contact to form an electrical connection. For example, a wire contact may have a crimp end for terminating the wire and a male or female mating end for a mating contact. Some contacts have been developed from metal strips or pre-plated metal strips, which are stamped and then folded or formed into the appropriate shape. These contacts have a generally box shaped mating end for mating to a contact having a pin or blade type mating end. Contacts with a boxed shaped mating end have external size and shape requirements to fit into a cavity of a connector and an internal design for providing the mechanical and electrical connection means for receiving and holding the pin or blade contact of the mating contact. In current contacts having generally boxed shaped mating ends, a contact or compliant beam may be the means to receive and hold the mating pin contact.

However, known connectors typically contact and mate the pin or mating contact at up to two points. This can result in a lack of sufficient physical contact that reduces the reliability of the electrical connection and renders the connector susceptible to reduction or loss of connection. Further, vibration or other motion or movement may result in a loss of connection.

In addition, some known connectors have contact beams that have a high spring force, which decreases the ability to control the normal force applied by the contact beam, increasing the mating force of the connector, and increasing tolerance sensitivity. Other connector problems may arise from having the contact beam exposed to the mating pin, leaving the contact beam unprotected from damage from external factors.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

A first aspect of the present disclosure includes a socket contact having a mating portion, a crimp portion, and a transition region connecting the mating portion with the crimp portion. The mating portion includes a top wall and a bottom wall joined by two opposing sidewalls, wherein the top, bottom and two opposing sidewalls form a contact box open at, at least one end and configured to accept a pin contact. The contact box includes a first contact beam and a second contact beam. Each of the first contact beam and second contact beam includes a free end and a fixed end. The free end has a plurality of contact fingers. Each of the first contact beam and the second contact beam has a plurality of contact points.

Another aspect of the present disclosure includes an electrical connection system having a socket contact and a pin contact. The socket contact includes a mating portion, a crimp portion, and a transition region connecting the mating portion with the crimp portion. The mating portion includes a top wall and a bottom wall joined by two opposing sidewalls, wherein the top, bottom and two opposing sidewalls form a contact box open at, at least one end. The contact box includes a first contact beam and a second contact beam. Each of the first contact beam and second contact beam includes a free end and a fixed end. The free end has a plurality of contact fingers. Each of the first contact beam and the second contact beam has a plurality of contact points. A pin contact is inserted into the contact box and is in physical contact with each of the contact points.

Another aspect of the present disclosure includes a socket contact having a mating portion with a front aperture, a crimp portion, and a transition region connecting the mating portion with the crimp portion. The mating portion has a first contact beam and a second contact beam. The first contact beam extends from a first fixed end proximate the transition region to a first free end proximate the front aperture of the mating portion. The first contact beam has a cantilevered portion with at least one first contact finger extending therefrom. The at least one first contact finger has a first finger contact point along a surface thereof. The first finger contact point is positioned proximate the front aperture and spaced from the first fixed end. The first contact beam has an inflexible first fixed contact point which is positioned on the surface of the first contact beam proximate the first finger contact point and between the first finger contact point and the first fixed end. As a mating pin is inserted through the front aperture of the mating portion, the mating pin engages the first finger contact point causing the first contact beam to deflect. The mating pin then engages the inflexible first fixed contact point at a shallow mating angle and a reduced normal force, resulting in the first contact beam of the mating portion of the socket contacting the mating pin at multiple points of contact.

One advantage of the present disclosure is reduced force requirement for connection of a mating pin.

Another advantage of the present disclosure is a connector that is resistant to vibration.

A further advantage of the present disclosure is the use of a plurality of contact points within the connection, increasing the reliability of the electrical connection.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, like reference numerals are used to refer to like elements throughout the application.

DETAILED DESCRIPTION OF THE INVENTION

Before turning to the figures, which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
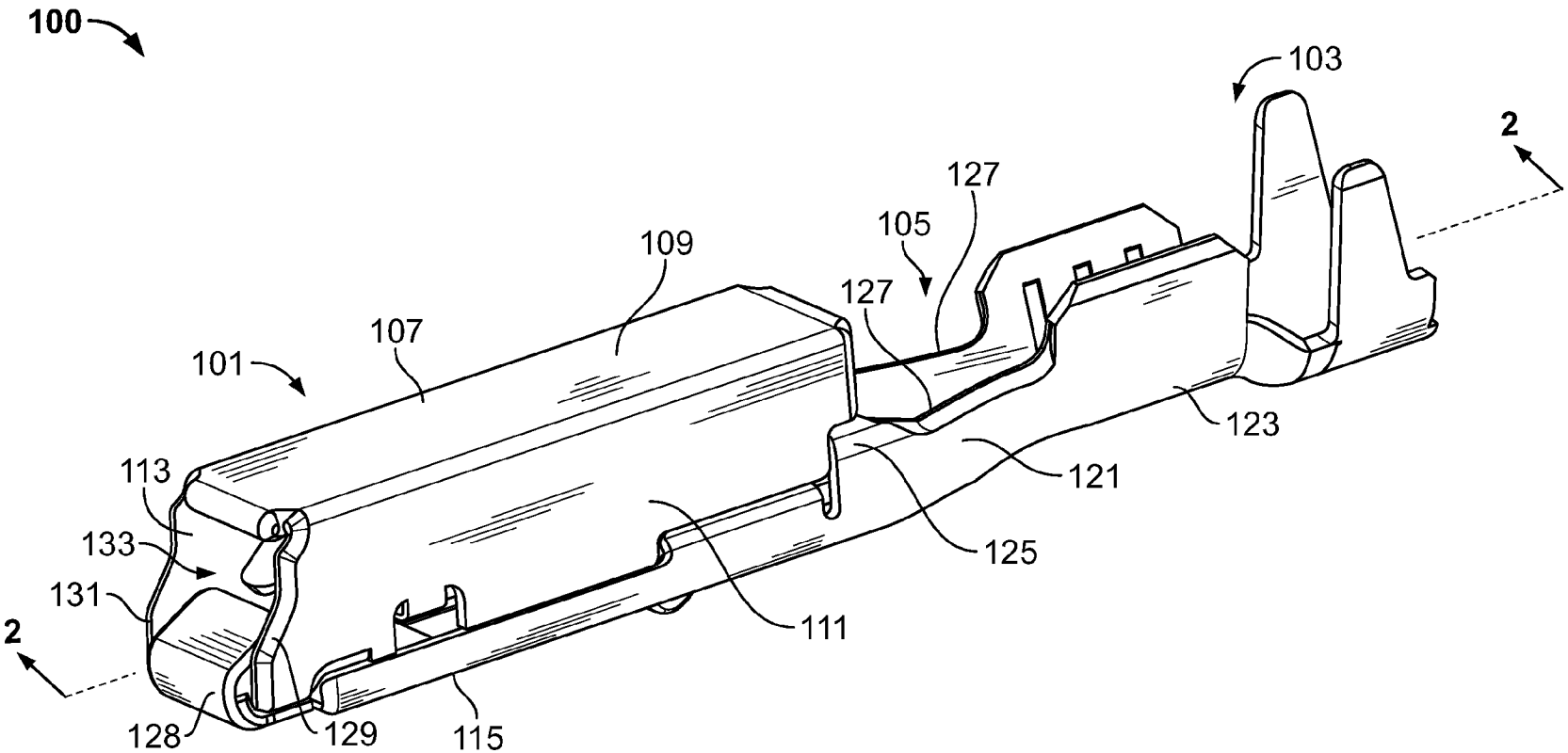
FIG. 1 shows a perspective side view of an exemplary embodiment of the contact of the present invention.
Figure 7:
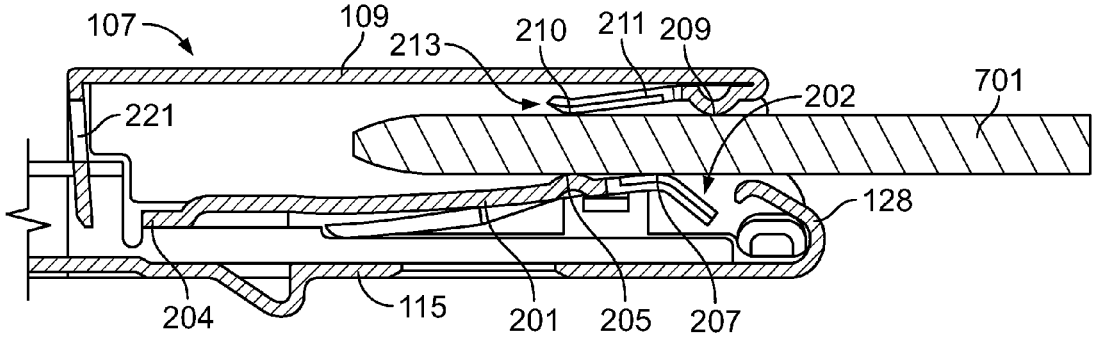
FIG. 7 shows a cross-section side view taken through the center of the contact box of FIG. 1 with a contact pin inserted.

FIG. 1 shows a perspective view of a socket contact 100 including a mating portion 101, a crimp portion 103 and a transition portion or region 105. The mating portion 101 includes a contact box 107 for accepting a mating pin contact 701 (FIG. 7). As shown in the exemplary embodiment, the mating portion 101 is generally a box shape having a top wall 109, two sidewalls 111 and 113 and a bottom wall 115. However, other configurations of the mating portion may be used without departing from the scope of the invention. Contact 100 includes a rounded front fold over flap 128. The front fold over flap 128 protects the first contact beam 201 (FIG. 2) from being damaged by a mating pin contact 701 during insertion of the mating pin contact 701 into the contact box 107. The flap 128 prevents interference during mating insertion, and provides a location for a continuity probe. Additionally, the front fold over flap 128 provides a rounded or contoured surface that first contacts a seal, when the contact 100 is inserted into a sealed connector. The contoured surface reduces pinching or stretching of the seal and thus reduces the chance of damaging the seal.

The contact 100 also includes angled front lead-in edges 129, 131 to provide a smooth lead-in at the top of the contact box 107 to further reduce seal damage. In the exemplary embodiment, contact box sidewalls 111, 113 include lead-in edges 129 and 131, respectively, at the front end of the contact box 107. Lead-in edges 129, 131 may be coined to provide additional protection against cutting or otherwise damaging the seal. A front aperture 133 is disposed above the front fold-over flap 128 and is generally defined by the walls 109, 111, 113, and 115 of the contact box 107. The front aperture 133 receives a mating contact pin 701 (FIG. 7).

Figure 2:
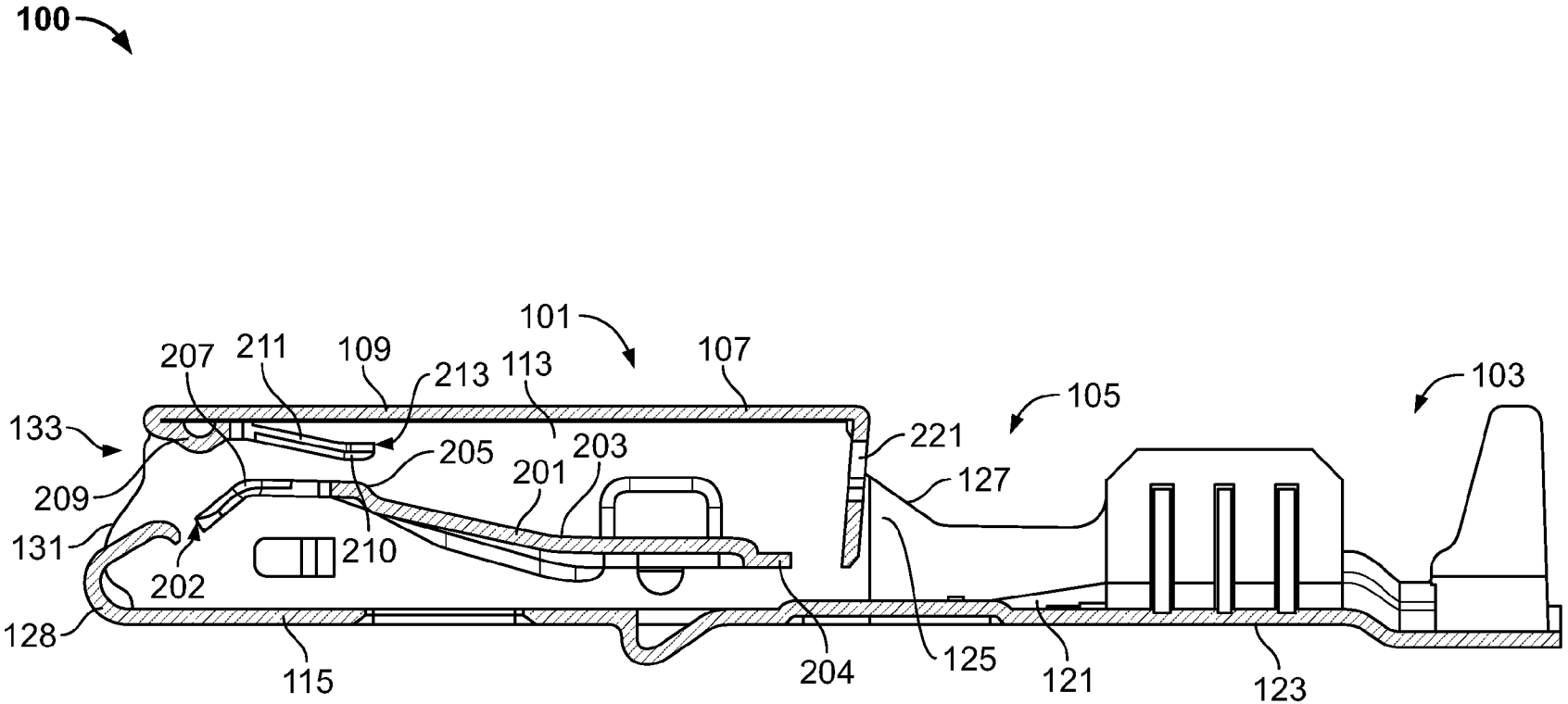
FIG. 2 shows a cross-section side view taken through the center of the contact box of FIG. 1.

Referring to FIGS. 1 and 2, the transition region 105 extends between the mating portion 101 and the crimp portion 103. The transition region 105 includes a bottom wall 121 extending from the bottom wall 115 of the contact box 107 to the bottom wall 123 of the crimp portion 103. The transition region 103 has sidewalls 125 extending from the bottom wall 121 to top edges 127. As further shown in FIGS. 1 and 2, the transition region top edges 127 of the sidewalls 125 are angled from a low point adjacent to the crimp portion 103 to the apex where the sidewalls 125 merge into sidewalls 111, 113, respectively, of the contact box 107. The angled top edges 127, partially deform inward from the sidewalls 111, 113 when crimped, to help shield wire strands in the cable from coming in contact with the seal. The angled top edges 127 also increase the bend strength of the crimp. Contact box 107 further includes an opening 221, which allows light to be projected through the rear of the contact box 107 so that a beam gap can be measured during production. "Beam gap," as utilized herein includes a distance between the first contact beam 201 and the second contact beam 211. For example, the beam gap may correspond to the distance between the first center contact point 205 and the second center contact point 209 into which a mating pin contact 701 may be inserted. The measuring of the beam gap through opening 221 permits inspection of the socket contact 100 and allows for adjustments in manufacturing to adjust the normal forces of the first beam 201 and second beam 211 corresponding to force required to insert a mating pin contact 701.

FIG. 2 shows a cross-sectional view of the socket contact 100 of FIG. 1 taken in direction 2-2. As shown in FIG. 2, mating portion 101 further includes first contact beam 201 that may be formed from the same sheet of material from which the contact box 107 is formed. Alternately, the first contact beam 201 may be formed separately and inserted into the contact box 107. The first contact beam 201 extends from a fixed end along the length of the contact box 107 to a free end 202, which allows the first contact beam 201 to be compliant in response to insertion forces on the free end 202. The fixed end includes a point of attachment wherein the first contact beam 201 is attached to or integrally formed with contact box 107. First contact beam 201 is affixed to the sidewalls 111 and 113 at a torsional segment 204 in close proximity to the end of the contact box 107 opposite the end having front aperture 133. However, the first contact beam 201 may be affixed to contact box 107 in any suitable manner that permits the cantilevered extension of the first contact beam 201 to the free end 202.

The first contact beam 201 has the torsional segment or torsional beam section 204 provided proximate the end of the contact box 107 opposite the end having the front aperture 133. A cantilever beam section 250 extends from the torsional beam section 204 toward the front aperture 133. The first center contact point 205 is positioned on the cantilever beam section 250. A bifurcated cantilever beam section 252 extends from the cantilever beam section 250 to the free end 202 of the first contact beam 201. The bifurcated cantilever beam section 252 has two contact fingers 301, with each contact finger having a finger contact point 207 positioned on a surface thereof. The bifurcated cantilever beam section 252 is more easily displaced than the relatively stiff cantilever beam section 250. The first contact beam 201 may include an embossment rib 203 which extends from the torsional beam section 204 to the cantilever beam section 250. The embossment rib 203 provides increased beam stiffness to achieve the desired normal force for the insertion of a mating pin contact 701 (see e.g., FIG. 7). The embossment rib 203 provides a distribution of mechanical stresses so that a larger portion of the beam is used for the normal force. This reduces or eliminates the need for an assist spring to help create the required normal force for mating. The first contact beam 201 includes a first center contact point 205, and a set of two finger contact points 207 at free end 202.

As also shown in FIG. 2, socket contact 100 includes a second contact beam 211 extending from a fixed end along top wall 109. The second contact beam 211 may be formed from the same sheet of material from which the contact box 107 is formed. Alternately, the second contact beam 211 may be formed separately and inserted into the contact box 107. Like first contact beam 201, the second contact beam 211 includes a free end 213 and a second center contact point 209 and a second set of two finger contact points 210. The second contact beam 211 has a stiff section 260 which extends from the front aperture 133 toward the end of the contact box 107 opposite the end having the aperture 133. The second fixed center contact point 209 is positioned on the stiff section 260.

A bifurcated flexible cantilever beam section 262 extends from the stiff section 260 to the free end of the second contact beam 211. The bifurcated cantilever beam section 262 has two contact fingers 401, with each contact finger having a finger contact point 210 positioned on a surface thereof. The bifurcated cantilever beam section 262 is more easily displaced than the stiff section 260.

Figure 5:
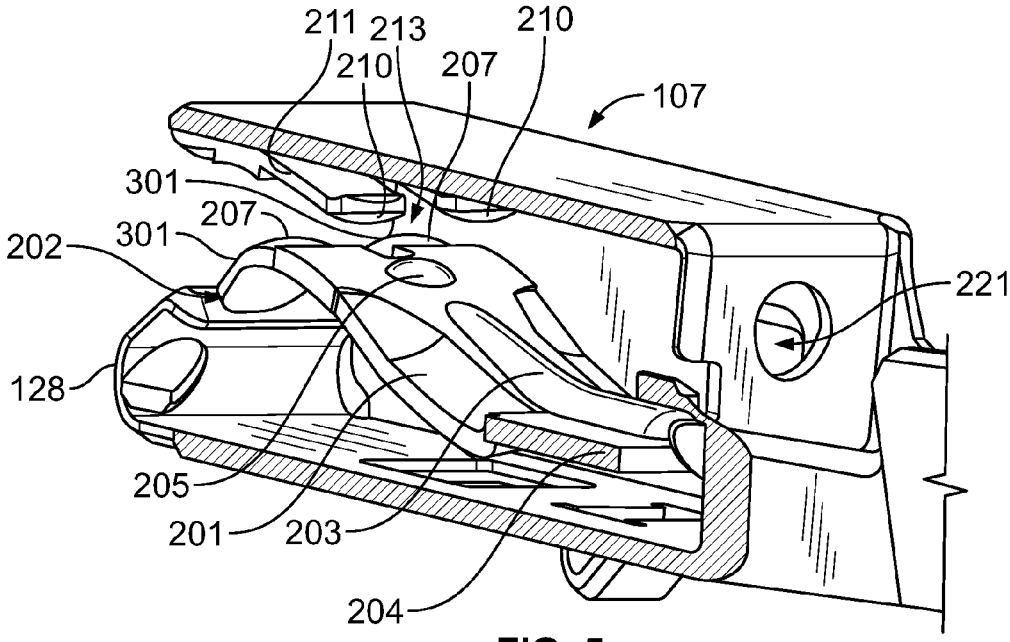
FIG. 5 shows a rear partially cutaway view of the contact box according to an embodiment of the present disclosure.
Figure 6:
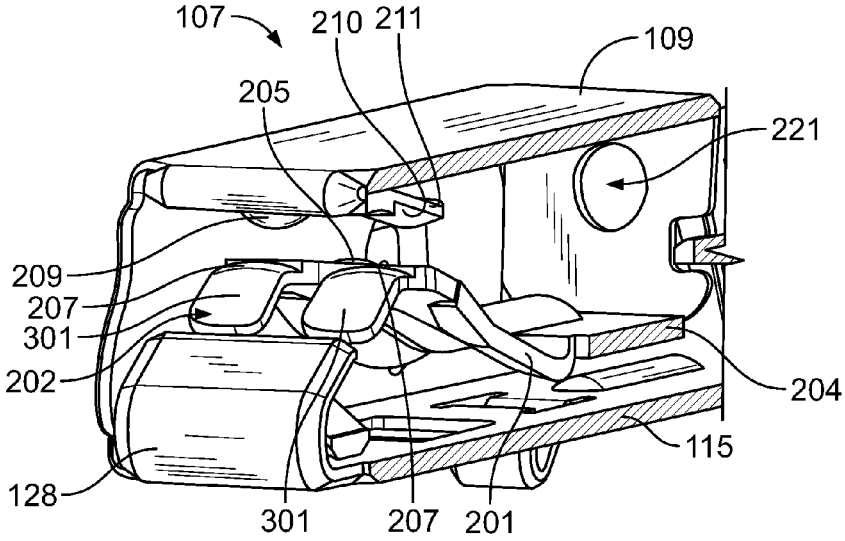
FIG. 6 shows a front partially cutaway view of the contact box according to an embodiment of the present disclosure.

The contact points 205, 207 of the first contact beam 201 and the contact points 209, 210 of the second contact beam 211 provide at least six locations that physically contact a mating pin contact 701 (see also FIGS. 5 and 6). The plurality of physical contact locations provides a good electrical connection and provides resistance to vibration, jarring and unintentional disconnection. Although not so limited, the second contact beam 211 may be formed by bending down a portion of top wall 109 and forming the contact points 209, 210.

Figure 3:
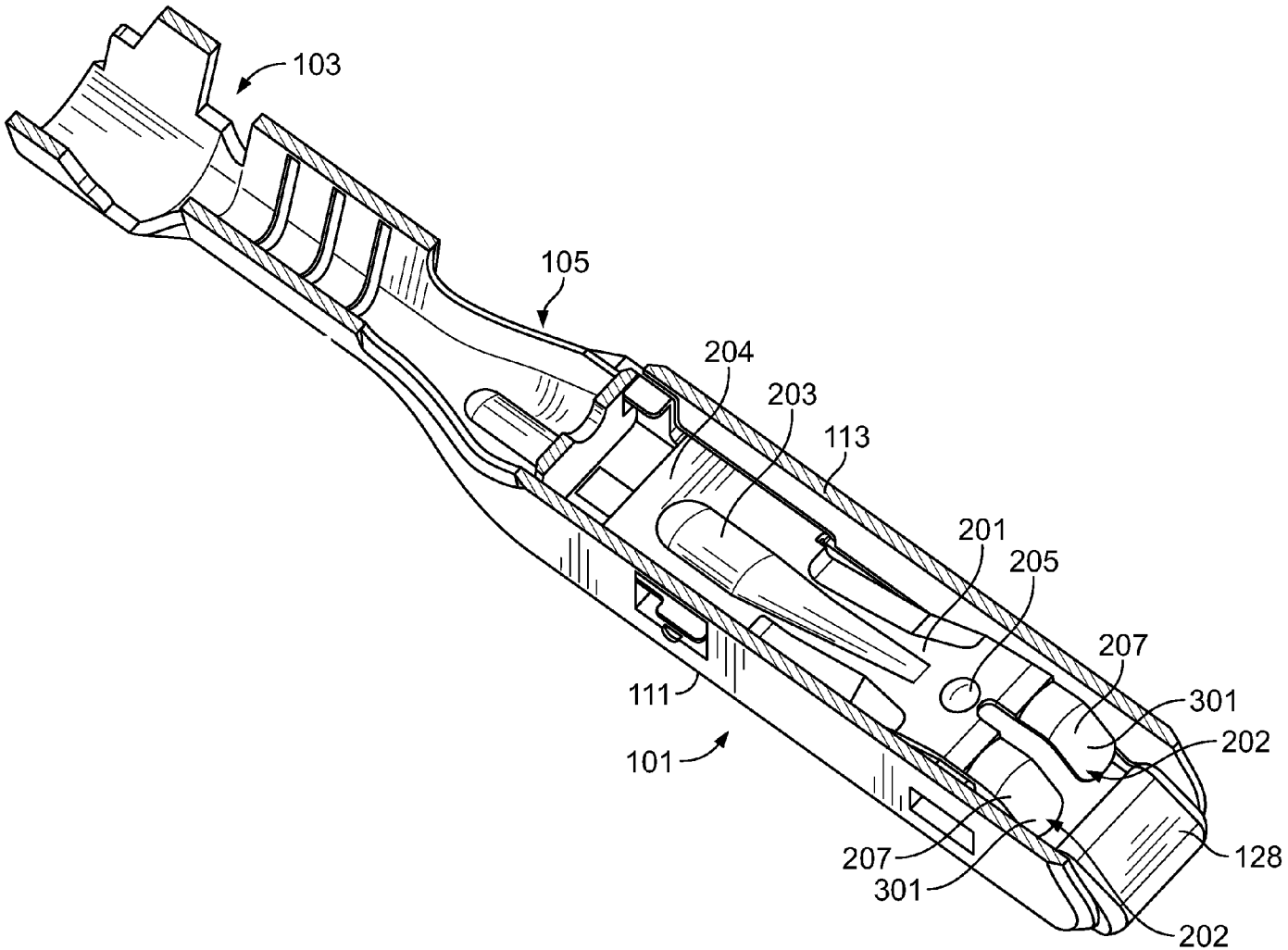
FIG. 3 shows a top perspective view of the contact box of the contact of FIG. 1 with the top wall removed.

As shown in FIGS. 3 and 5-6, the bifurcated cantilever beam section 252 of the first contact beam 201 includes a divided portion made up of two contact fingers 301. FIG. 5 shows a rear partially cutaway view of the contact box 107 of the embodiment of FIG. 1. FIG. 6 shows a front partially cutaway view of the contact box 107 of the embodiment of FIG. 1. The contact fingers 301 include finger contact points 207 along a surface thereof. The cantilever beam section 250 of the first contact beam 201 includes an inflexible fixed center contact point 205 near the front aperture 133. The finger contact points 207 and first center contact point 205 are arranged and disposed along first contact beam 201 to provide simultaneous physical contact between the mating pin contact 701 and contact points 205, 207. Once in position, the mating pin contact 701 (see e.g., FIG. 7) provides up to three and preferably three physical contact points 205, 207 that resist twisting or misalignment. These three contact points 205, 207 preferably provide an equal and opposite force to resist the force generated by the second contact beam 211.

In order for the mating pin contact 701 to be placed in electrical engagement with all three contact points 205, 207, the contact fingers 301 of the bifurcated cantilever beam section 252 must generate less force than the second fixed center contact point 209 of the second contact beam 211. In so doing, the contact points 207 on the contact fingers 301 of the bifurcated cantilever beam section 252 are forced to be displaced a sufficient distance to allow the mating pin contact to exert force on all three contact points 205, 207. Consequently, the contact points 207 of the contact fingers 301 of the bifurcated cantilever beam section 252 generate some of the resisting force, and the remainder is provided by the first fixed center contact point 205. This allows the mating pin contact 701 to be always adjacent to the first fixed center contact point 205 and provide electrical connection therebetween. The contact points 207 on the contact fingers 301 provide stability to resist motion during vibration and the like. The contact points 207 also are provided in electrical engagement with the mating pin contact 701.

Figure 4:
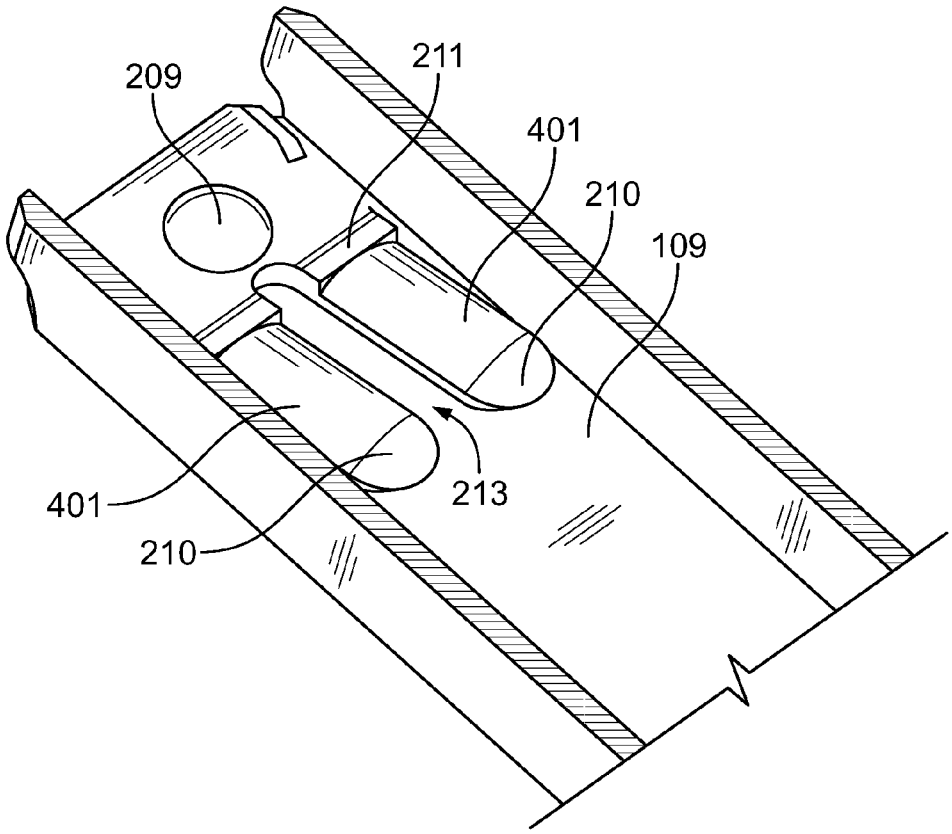
FIG. 4 shows a bottom perspective view of the contact box with the bottom wall and sidewalls removed.

As shown in FIGS. 4 and 5-6, the bifurcated cantilever beam section 262 of the second contact beam 211 includes a divided portion made up of two contact fingers 401. The contact fingers 401 include finger contact points 210 along a surface thereof. The stiff section 260 of the second contact beam 211 includes an inflexible fixed center contact point 209 near the front aperture 133. The finger contact points 210 and second center contact point 209 are arranged and disposed along second contact beam 211 to provide simultaneous physical contact between the mating pin contact 701 and contact points 209, 210. Once in position, the mating pin contact 701 (see e.g., FIG. 7) provides up to three and preferably three physical contact points 209, 210 that resist twisting or misalignment. These three contact points 209, 210 preferably provide an equal and opposite force to resist the force generated by the first contact beam 201.

In order for the mating pin contact 701 to be placed in electrical engagement with all three contact points 209, 210, the contact fingers 401 must generate less force than the first fixed center contact point 205 of the first contact beam 201. In so doing, the contact points 210 on the contact fingers 401 are forced to be displaced a sufficient distance to allow the mating pin contact to exert force on all three contact points 209, 210. Consequently, the contact points 210 of the contact fingers 401 of the bifurcated cantilever beam section 262 generate some of the resisting force, and the remainder is provided by the second fixed center contact point 209. This allows the mating pin contact 701 to be always adjacent to the second fixed center contact point 209 and provide electrical connection therebetween. The contact points 210 on the contact fingers 401 provide stability to resist motion during vibration and the like. The contact points 210 also are provided in electrical engagement with the mating pin contact 701.

FIG. 7 shows a cross-sectional view of the socket contact 100 of FIG. 1 taken in direction 2-2 wherein a mating pin contact 701 has been inserted into the contact box 107. Each of the first contact beam 201 and second contact beam 211 is deflected to permit insertion of the mating pin contact 701. The mating pin contact 701 is in physical contact with up to six contact points 205, 207, 209, 210 (see also FIGS. 5 and 6), corresponding to three contact points 205, 207 on the first contact beam 201 and three contact points 209, 210 on the second contact beam 211. While the above has been shown and described with respect to a "pin contact," the invention is not so limited and may include any configuration of electrical contact that is insertable into the contact box 107, such as a tab, wire, plug or other electrical contact device.

During insertion of the mating pin contact 701, the mating pin contact 701 contacts the two finger contact points 207 of the bifurcated contact fingers 301 of the bifurcated cantilever beam section 252, which provide a "lifting" or moving force that reduces the mating force. Specifically, the first contact beam 201 is cantilevered at a distance from the torsional segment 204 to free end 202 of the bifurcated cantilever beam section 252, resulting in a lift force that corresponds to a lowered normal force. The mating force of the two finger contact points 207 is lower than the mating force of the first center contact point 205, as the two finger contact points 207 are located at a further distance from the torsional beam section or segment 204. The mating force or the force required to deflect the first contact beam 201 is a cubic function of the distance or length from the torsional beam section to the respective contact point. As insertion continues, an inflexible second center contact point 209 is contacted with the mating pin contact 701 after the lifting of the first contact beam 201 is substantially complete.

As mating pin contact 701 insertion is continued, the mating pin contact 701 physically contacts the first center contact point 205 and finger contacts 210. The first center contact point 205 is engaged by the mating pin contact 701 after the first contact beam 201 is almost fully deflected or "lifted" by the bifurcated cantilever beam section 252. This allows the first contact point 205 to contact the mating pin contact 701 with a low mating force and a shallow mating angle, thereby allowing the first center contact point 205 to be placed in electrical contact with the mating pin contact 701 with minimal wear on the first center contact point 205 and the plating thereof.

Wear on the mating pin contact 701 is also minimized. As the first center contact point 205 and the two finger contact points 207 are transversely offset relative to the path of insertion of the mating pin contact 701, and as the second center contact point 209 and the two finger contact points 210 are transversely offset relative to the path of insertion, the plating wear on the mating pin contact 701 at any particular point is minimized, as the wear is distributed over different areas.

The flexibility of the contact fingers 301, 401 permits up to six contact points 205, 207, 209, 210 to physically touch the mating pin contact 701 simultaneously when fully mated for mechanical and/or electrical stability. The two bifurcated contact fingers 301, 401 generate at least some of the resisting force; the remaining resisting force is provided by the fixed center contact points 205, 209 such that the mating pin contact 701 is located in physical contact with each of the contact points 205, 207, 209, 210. In addition, the two bifurcated contact fingers 301, 401 and the corresponding finger contacts 207, 210 provide stability to resist motion during vibration.

The configuration of the first contact beam 201, the second contact beam 211 and the use of multiple contact points allows for a lower normal force during mating and unmating of the mating contact pin 701 from the socket contact 100. This allows the socket contact 701 to be more durable over numerous cycles, as there is less plating wear due to the lower mating or normal forces. The number of contact points also allows the socket contact to be used at higher current levels, as the number of contact points prevents welding of the contact asperities due to extreme heating associated with the current levels.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A socket contact comprising:

a mating portion having a front aperture and a transition region, the mating portion comprising:

a first contact beam and a second contact beam;

the first contact beam extending from a first fixed end, the first contact beam having a cantilevered portion with at least one first contact finger extending therefrom, the at least one first contact finger having a first finger contact point along a surface thereof, the first finger contact point positioned proximate the front aperture and spaced from the first fixed end, the first contact beam having a first beam contact point, the first beam contact point being positioned on the surface of the first contact beam proximate the first finger contact point and between the first finger contact point and the first fixed end;

the second contact beam extending from a second fixed end, the second contact beam having at least one second contact finger extending from an second beam contact point, the at least one second contact finger having a second finger contact point along a surface thereof, the second beam contact point positioned proximate the front aperture, the second finger contact point being positioned on the surface of the second contact beam proximate the second beam contact point;

whereby as a mating pin is inserted through the front aperture of the mating portion, the mating pin engages the first finger contact point causing the first contact beam to deflect, the mating pin then engages the first beam contact point at a shallow mating angle and a reduced normal force, resulting in the first contact beam of the mating portion of the socket contacting the mating pin at multiple points of contact.

2. The socket contact of claim 1, wherein two at least one first contact fingers extend from the cantilevered portion of the first beam, each at least one first contact finger having at least one first contact point.

3. The socket contact of claim 1, wherein the first contact beam comprises an embossment rib for achieving a predetermined beam stiffness and normal force.

4. The socket contact of claim 1, wherein two at least one second contact fingers extend from the second beam contact point of the second contact beam, each at least one second contact finger having at least one second contact point.

5. The socket contact of claim 1, wherein the at least one second contact finger is flexible relative to the second beam contact point.

6. The socket contact of claim 1, wherein the first contact beam has one first beam contact point and two first finger contact points and the second contact beam has one second beam contact point and two second finger contact points.

7. The socket contact of claim 6, wherein the contact points are arranged and disposed to physically contact the mating pin contact positioned within the mating portion at up to six points.

8. The socket contact of claim 1, wherein the mating portion comprises an opening configured to project a light beam through the mating portion to determine a separation distance between the first contact beam and the second contact beam prior to the insertion of the mating pin contact therebetween.

9. A socket contact comprising:

a mating portion having a front aperture and a transition region, the mating portion comprising:

a first contact beam and a second contact beam;

the first contact beam extending from a first fixed end proximate the transition region to a first free end proximate the front aperture of the mating portion, the first contact beam having a cantilevered portion with at least one first contact finger extending therefrom, the at least one first contact finger having a first finger contact point along a surface thereof, the first finger contact point positioned proximate the front aperture and spaced from the first fixed end, the first contact beam having an inflexible first fixed contact point, the inflexible first fixed contact point being positioned on the surface of the first contact beam proximate the first finger contact point and between the first finger contact point and the first fixed end;

the second contact beam extending from a second fixed end proximate the front aperture of the mating portion to a second free end spaced from the front aperture of the mating portion, the second contact beam having at least one second contact finger extending from an inflexible second fixed contact point, the at least one second contact finger having a second finger contact point along a surface thereof, the inflexible second fixed contact point positioned proximate the front aperture, the second finger contact point being positioned on the surface of the second contact beam proximate the inflexible second fixed contact point.

10. The socket contact of claim 9, wherein two at least one first contact fingers extend from the cantilevered portion of the first beam, each at least one first contact finger having at least one first contact point.

11. The socket contact of claim 9, wherein the at least one first contact finger is flexible relative to the cantilevered portion.

12. The socket contact of claim 9, wherein the first contact beam comprises an embossment rib for achieving a predetermined beam stiffness and normal force.

13. The socket contact of claim 9, wherein two at least one second contact fingers extend from the inflexible second fixed contact point of the second contact beam, each at least one second contact finger having at least one second contact point.

14. The socket contact of claim 9, wherein the at least one second contact finger is flexible relative to the inflexible second fixed contact point.

15. The socket contact of claim 9, wherein the first contact beam has one inflexible first fixed contact point and two first finger contact points and the second contact beam has one inflexible second fixed contact point and two second finger contact points.

16. The socket contact of claim 15, wherein the contact points are arranged and disposed to physically contact a mating pin contact positioned within the mating portion at up to six points.

17. The socket contact of claim 9, wherein the mating portion comprises an opening configured to project a light beam through the mating portion to determine a separation distance between the first contact beam and the second contact beam prior to the insertion of a mating pin contact therebetween.

18. The socket contact of claim 9, wherein as a mating pin is inserted through the front aperture of the mating portion, the mating pin engages the first finger contact point causing the first contact beam to deflect, the mating pin then engages the inflexible first fixed contact point at a shallow mating angle and a reduced normal force, resulting in the first contact beam of the mating portion of the socket contacting the mating pin at multiple points of contact.

* * * * *